US010386768B2

(12) United States Patent
Sakaguchi

(10) Patent No.: US 10,386,768 B2
(45) Date of Patent: Aug. 20, 2019

(54) IMAGE FORMING APPARATUS, INFORMATION PROCESSING METHOD, AND STORAGE MEDIUM

(71) Applicant: CANON KABUSHIKI KAISHA, Tokyo (JP)

(72) Inventor: Toru Sakaguchi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 41 days.

(21) Appl. No.: 15/659,312

(22) Filed: Jul. 25, 2017

(65) Prior Publication Data

US 2018/0032017 A1 Feb. 1, 2018

(30) Foreign Application Priority Data

Aug. 1, 2016 (JP) ..... 2016-151271

(51) Int. Cl.
*G03G 15/00* (2006.01)
*G03G 15/08* (2006.01)
*G03G 21/16* (2006.01)

(52) U.S. Cl.
CPC ..... *G03G 15/556* (2013.01); *G03G 15/502* (2013.01); *G03G 15/5079* (2013.01); *G03G 15/0855* (2013.01); *G03G 15/0894* (2013.01); *G03G 21/1633* (2013.01)

(58) Field of Classification Search
CPC ..... G03G 15/556
See application file for complete search history.

(56) References Cited

U.S. PATENT DOCUMENTS

2009/0034995 A1* 2/2009 Mochizuki ..... G03G 21/1889 399/27
2015/0062634 A1* 3/2015 Saiki ..... G06K 15/4075 358/1.15
2015/0063839 A1* 3/2015 Takahashi ..... G03G 15/50 399/27
2015/0063841 A1* 3/2015 Saiki ..... G03G 15/0863 399/27
2016/0033895 A1* 2/2016 Noda ..... G03G 15/0853 399/12

FOREIGN PATENT DOCUMENTS

JP 2002-287583 A 10/2002

* cited by examiner

*Primary Examiner* — Ryan D Walsh
(74) *Attorney, Agent, or Firm* — Canon USA, Inc., IP Division

(57) ABSTRACT

A printer controller determines whether a cartridge refilled with a recording material is mounted on an image forming apparatus. If it is determined that the cartridge refilled with the recording material is mounted on the image forming apparatus, control for shifting a printer engine to a predetermined state is performed, raw data is acquired from the printer engine that has been shifted to the predetermined state, and a user is notified of the degree of wear of the cartridge based on the acquired raw data. On the other hand, if the printer controller determines that the cartridge refilled with the recording material is not mounted on the image forming apparatus, the printer controller acquires a predicted value from the printer engine, and notifies the user of the degree of wear of the cartridge based on the predicted value.

8 Claims, 8 Drawing Sheets

FIG. 7

601

| TONER REMAINING AMOUNT (SENSOR VALUE) ACQUIRED FROM PRINTER ENGINE [%] | COUNT THRESHOLD [SHEETS] |
|---|---|
| 100 | NUMBER OF PRINTED SHEETS EQUIVALENT TO 30% OF CARTRIDGE CAPACITY |
| 40 | NUMBER OF PRINTED SHEETS EQUIVALENT TO 15% OF CARTRIDGE CAPACITY |
| 20 | NUMBER OF PRINTED SHEETS EQUIVALENT TO 10% OF CARTRIDGE CAPACITY |
| 10 | NUMBER OF PRINTED SHEETS EQUIVALENT TO 3% OF CARTRIDGE CAPACITY |

IMAGE FORMING APPARATUS, INFORMATION PROCESSING METHOD, AND STORAGE MEDIUM

BACKGROUND

Field of the Disclosure

The present disclosure generally relates to an image forming apparatus, an information processing method, and a storage medium.

Description of the Related Art

A user himself/herself can exchange cartridges in some image forming apparatuses. Therefore, such image forming apparatuses include a unit that detects a remaining amount of toner (hereinafter, sometimes referred to as "toner remaining amount") in the cartridge and displays the remaining amount of toner to the user. Similarly, some image forming apparatuses include a unit that displays to the user a warning indicating that the remaining amount of toner is low or the toner has run out when such toner shortage occurs. These units can prompt the user to exchange cartridges before the printing quality deteriorates.

An image forming apparatus generally includes a printer engine that functions as an image output device, and a controller that controls input/output of image data and device information between a terminal such as a personal computer (PC), a display unit, or an operation unit, and the printer engine.

There are two types of toner remaining amount of which the printer engine notifies the controller, i.e., a sensor value and a calculated value. The sensor value is obtained by reading the toner remaining amount in the cartridge with an optical sensor, for example. The calculated value is calculated using a specific logic based on the sensor value and a use situation of the image forming apparatus. The calculated value is different from the sensor value and does not rebound, that is, does not exceed the value calculated last time. In a case where a refilled cartridge, which has once run out of the toner and then has been refilled with toner, is mounted, the calculated value is constantly 0 since the toner has run out once, that is, the toner remaining amount has become 0.

As described above, in the case where the refilled cartridge is mounted, the calculated value does not indicate a value corresponding to the actual toner remaining amount. To grasp the toner remaining amount in the refilled cartridge, therefore, it is necessary to acquire the sensor value, not the calculated value.

Japanese Patent Application Laid-Open No. 2002-287583 discusses a technique for notifying of a detailed toner remaining amount using the toner capacity of a cartridge, a pixel counter, and information from a toner end sensor.

SUMMARY

According to one or more aspects of the present disclosure, an image forming apparatus includes a printer engine configured to perform image formation using a recording material stored in a cartridge, and a printer controller communicably connected to the printer engine, wherein the printer engine includes a first notification unit configured to notify the printer controller of a predicted value predicted based on a consumption amount of the recording material upon condition that an engine state does not satisfy a predetermined state, and to notify the printer controller of raw data acquired using a sensor, instead of the predicted value, upon condition that the engine state satisfies the predetermined state, and wherein the printer controller includes a determination unit configured to determine whether a cartridge refilled with a recording material is mounted on the image forming apparatus, and a second notification unit configured to perform control for shifting the printer engine to a predetermined state, acquire the raw data from the printer engine that has been shifted to the predetermined state, and notify a user of the degree of wear of the cartridge based on the acquired raw data upon condition that the determination unit has determined that the cartridge refilled with the recording material is mounted on the image forming apparatus, and to avoid performing the control for shifting the printer engine to the predetermined state, acquire the predicted value from the printer engine, and notify the user of a degree of wear of the cartridge based on the acquired predicted value upon condition that the determination unit has determined that the cartridge refilled with the recording material is not mounted on the image forming apparatus.

Further features of the present disclosure will become apparent from the following description of exemplary embodiments with reference to the attached drawings.

BRIEF DESCRIPTION OF THE DRAWINGS

FIG. 7 is a diagram illustrating an exemplary correspondence table between a toner remaining amount and a count threshold.

DESCRIPTION OF THE EMBODIMENTS

Hereinafter, one or more aspects of the present disclosure will be described with reference to the drawings. In the present exemplary embodiment, there is provided a mechanism capable of grasping a toner remaining amount even in a case where a refilled cartridge is mounted on an image forming apparatus.

Figure 1:
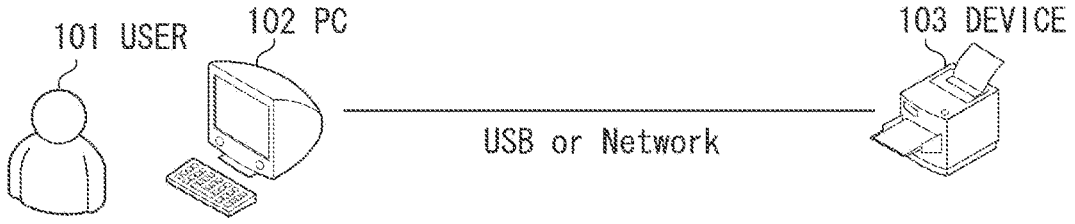
FIG. 1 is a diagram illustrating an exemplary system configuration of a printing system.

FIG. 1 is a diagram illustrating an exemplary system configuration of a printing system. The printing system includes a personal computer (PC) 102 and a device 103. The device (image forming apparatus) 103 is connected to the PC 102 by a universal serial bus (USB) or a network. A user 101 can make an arbitrary setting and issue an instruction to the device 103 by operating an operation unit 206 of the PC 102 or an operation/display unit 316 of the device 103. In the present exemplary embodiment, a printer having the operation/display unit 316 in a main body will be described as an example of the device 103; however, the device 103 is not limited to a printer but may be another image forming apparatus such as a multifunction peripheral (MFP).

It is assumed in the present exemplary embodiment that, in the device 103, a printer engine 314 does not include independent interfaces corresponding to sensor values and calculated values, but includes one interface corresponding to a toner remaining amount.

Figure 2:
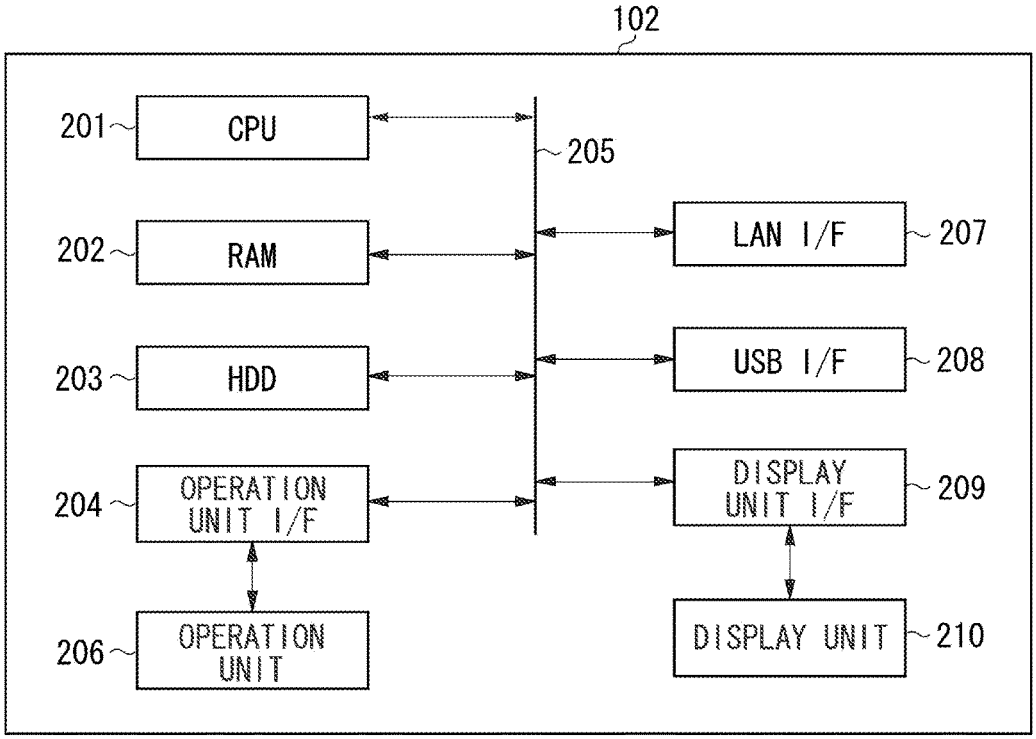
FIG. 2 is a diagram illustrating an exemplary hardware configuration of a personal computer (PC).

FIG. 2 is a diagram illustrating an exemplary hardware configuration of the PC 102. A central processing unit (CPU) 201 may control the entire system, and may include one or more processors, one or more memories, circuitry, or a combination thereof. A random access memory (RAM) 202 is a system work memory for the CPU 201 to operate, and is used as a program memory for recording a program. A hard disk drive (HDD) 203 is a data storage area. An operation unit interface (I/F) 204 is an interface unit with the operation unit 206 and receives an input signal from the operation unit 206. The operation unit I/F 204 also plays a role of notifying the CPU 201 of information input by the user through the operation unit 206. A display unit I/F 209 is an interface unit with a display unit 210 and outputs an output signal to the display unit 210 under the control of the CPU 201. A USB I/F 208 is a functional unit for connecting to a USB device, and is used to acquire the status of another device and to return the status via the USB device. A local area network (LAN) I/F 207 is a functional unit for connecting to a LAN, and is used to acquire the status of another device and to return the status via the LAN. The above devices are disposed on a system bus 205.

The units described throughout the present disclosure are exemplary and/or preferable modules for implementing processes described in the present disclosure. The modules can be hardware units (such as circuitry, a field programmable gate array, a digital signal processor, an application specific integrated circuit or the like) and/or software modules (such as a computer readable program or the like). The modules for implementing the various steps are not described exhaustively above. However, where there is a step of performing a certain process, there may be a corresponding functional module or unit (implemented by hardware and/or software) for implementing the same process. Technical solutions by all combinations of steps described and units corresponding to these steps are included in the present disclosure.

The function of the PC 102 may be implemented by the CPU 201 executing processing based on the program stored in the RAM 202 or the HDD 203.

Figure 3:
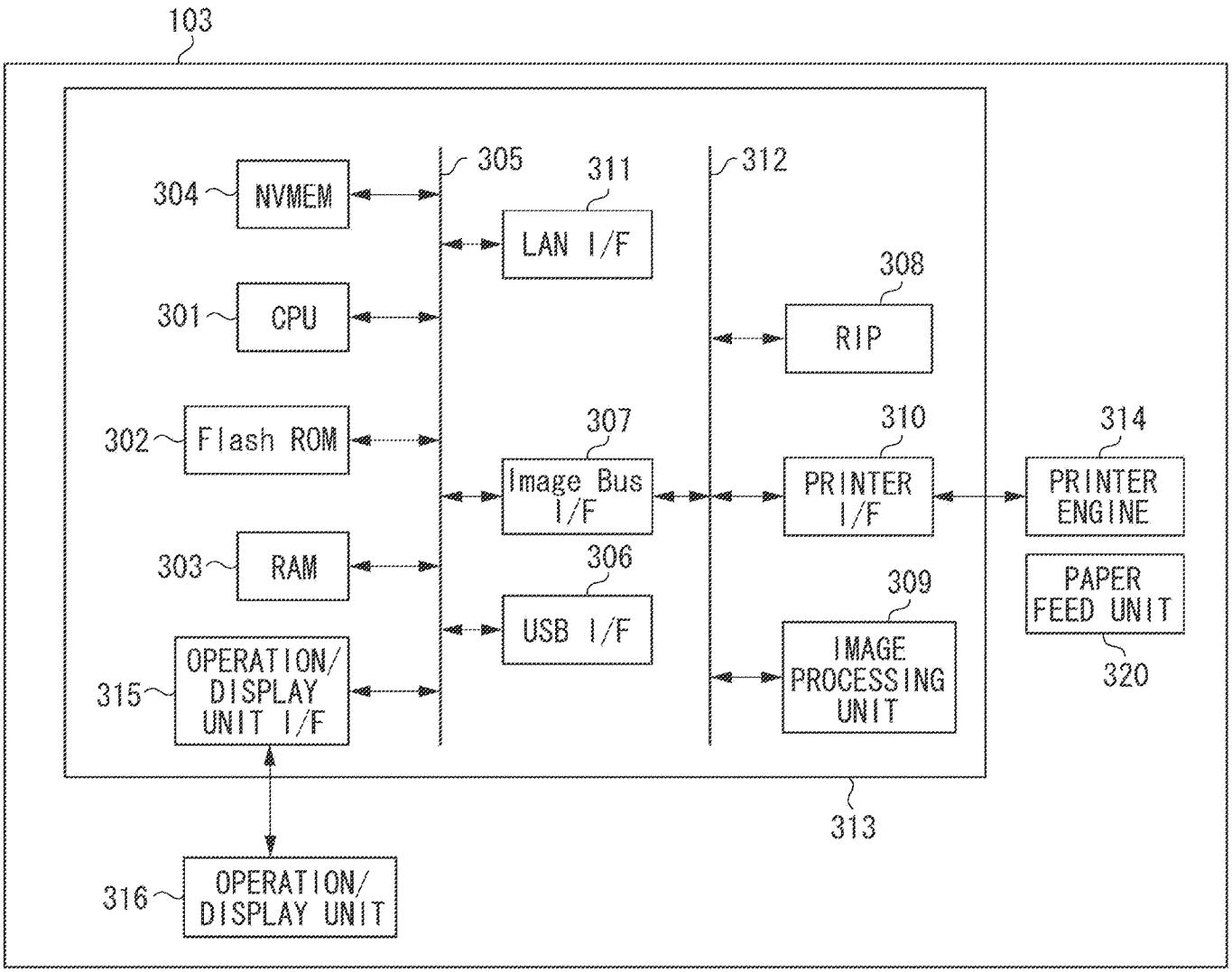
FIG. 3 is a diagram illustrating an exemplary hardware configuration of a device.

FIG. 3 is a diagram illustrating an exemplary hardware configuration of a controller 313 of the device 103 and devices connected to the controller 313. The controller 313 is connected to the printer engine 314 that functions as an image output device. With this configuration, the controller 313 inputs and outputs image data and device information between the PC 102 and the printer engine 314. In addition, the controller 313 can receive arbitrary settings and instructions from the user by being connected to the operation/display unit 316. A CPU 301 may control the entire system, and may include one or more processors and one or more memories. A RAM 303 is a system work memory for the CPU 301 to operate, and is also a program memory for recording a program as well as an image memory for temporarily recording image data. A nonvolatile memory (NVMEM) 304 records setting information, for example. A flash read only memory (ROM) 302 is a rewritable nonvolatile memory that records various control programs for controlling the system. An operation/display unit I/F 315 is an interface unit with the operation/display unit 316 and receives an input signal from the operation/display unit 316. The operation/display unit I/F 315 also plays a role of notifying the CPU 301 of information input by the user through the operation/display unit 316. In addition, the operation/display unit I/F 315 outputs an output signal to the operation/display unit 316 under the control of the CPU 301.

In the present exemplary embodiment, the operation/display unit 316 is a touch panel. A USB I/F 306 enables USB connection with the PC 102. A LAN I/F 311 enables LAN connection with the PC 102. The above devices are disposed on a system bus 305. An image bus I/F 307 is a bus bridge that connects the system bus 305 and an image bus 312 that transfers image data at a high speed, and converts a data structure. The image bus 312 includes a peripheral component interconnect (PCI) bus or an IEEE 1394 bus. The following devices are disposed on the image bus 312. A raster image processor (RIP) 308 expands vector data such as page description language (PDL) codes into a bitmap image. A printer I/F 310 connects the printer engine 314 and the controller 313, and performs synchronous/asynchronous conversion of image data and exchange of data. An image processing unit 309 corrects, processes, and edits input image data, and performs printer correction, resolution conversion, and other processing on print output image data. In addition, the image processing unit 309 rotates image data, and performs compression/decompression processing such as Joint Photographic Experts Group (JPEG) processing for multivalued image data, and Joint Bi-level Image Experts Group (JBIG), Modified Modified Read (MMR), or Modified Huffman (MH) processing for binary image data. The printer engine 314 converts raster image data into an image on paper. The conversion methods include, and may be any of, an electrophotographic method using a photosensitive drum or a photosensitive belt and an inkjet method for ejecting ink from a minute nozzle array and printing an image directly on paper. Activation of the printing operation is started by an instruction from the CPU 301. A recording material is stored in a paper feed unit 320.

The printer engine 314 acquires information such as the status of the printer engine 314, the cartridge, or the paper feed unit 320, and notifies the controller 313 of the information via the printer I/F 310. An example will be described in the present exemplary embodiment in which the printer engine 314 does not include independent interfaces corresponding to sensor values and calculated values, but includes one interface corresponding to the toner remaining amount.

When the controller 313 acquires the toner remaining amount from the printer engine 314, whether the printer engine 314 returns a sensor value or a calculated value depends on the status of the printer engine 314. The printer engine 314 returns the sensor value as the toner remaining amount to the controller 313 when the calculated value is not determined, and returns the calculated value otherwise, that is, when the calculated value is determined. The time during which the calculated value is not determined corresponds to a limited time interval after occurrence of any of the events including the power-on, closing of a cover to be accessed at the time of cartridge exchange, and recovery of the printer engine 314 from the sleep mode, until completion of printing of several sheets of paper. In the present exemplary embodiment, the condition as to whether the printer engine 314 notifies of the sensor value or the calculated value is as described above, but the range of applying the processing of the present exemplary embodiment is not limited to the above condition.

The printer engine 314 may notify the printer controller 313 of a predicted value predicted on a consumption amount of the recording material upon condition that an engine state does not satisfy a predetermined state, and may notify the printer controller 313 of raw data acquired using a sensor, instead of the predicted value, upon condition that the engine state satisfies the predetermined state. The printer controller 313 may determine whether a cartridge refilled with a recording material is mounted on the device 103. The printer controller 313 may perform control for shifting the printer engine 314 to a predetermined state, acquiring the raw data from the printer engine 314 that has been shifted to the predetermined state, and notifying a user of a degree of wear of the cartridge based on the acquired raw data upon condition that it has been determined in the determining that the cartridge refilled with the recording material is mounted on the device 103, and avoiding performing the control for shifting the printer engine 314 to the predetermined state, acquiring the predicted value from the printer engine 314, and notifying the user of the degree of wear of the cartridge based on the acquired predicted value upon condition that it has been determined in the determining that the cartridge refilled with the recording material is not mounted on the device 103.

The printer engine 314 may calculate the predicted value based on at least the raw data acquired using the sensor and the consumption amount of the recording material. The printer controller 313 may shift the printer engine 314 to the predetermined state by performing control for rebooting the printer engine 314. The printer controller 313 may transmit an acquisition request for a toner remaining amount to the printer engine 314, and the printer engine 314 may notify the printer controller 313 of the predicted value in response to the acquisition request upon condition that the engine state does not satisfy the predetermined state, and may notify the printer controller 313 of the raw data upon condition that the engine state satisfies the predetermined state. During a determination whether there is a print job to be executed, even upon condition that a determination is made that the cartridge refilled with the recording material is mounted on the device 103 and a determination is made that there is a job to be executed, the printer controller 313 may perform the control for shifting the printer engine 314 to the predetermined state after execution of the print job is completed.

By the CPU 301 executing the processing based on the program stored in the NVMEM 304 or the RAM 303, the function of the controller 313 and the processing of the flowcharts of FIGS. 5 and 6 described below are implemented.

Figure 4:
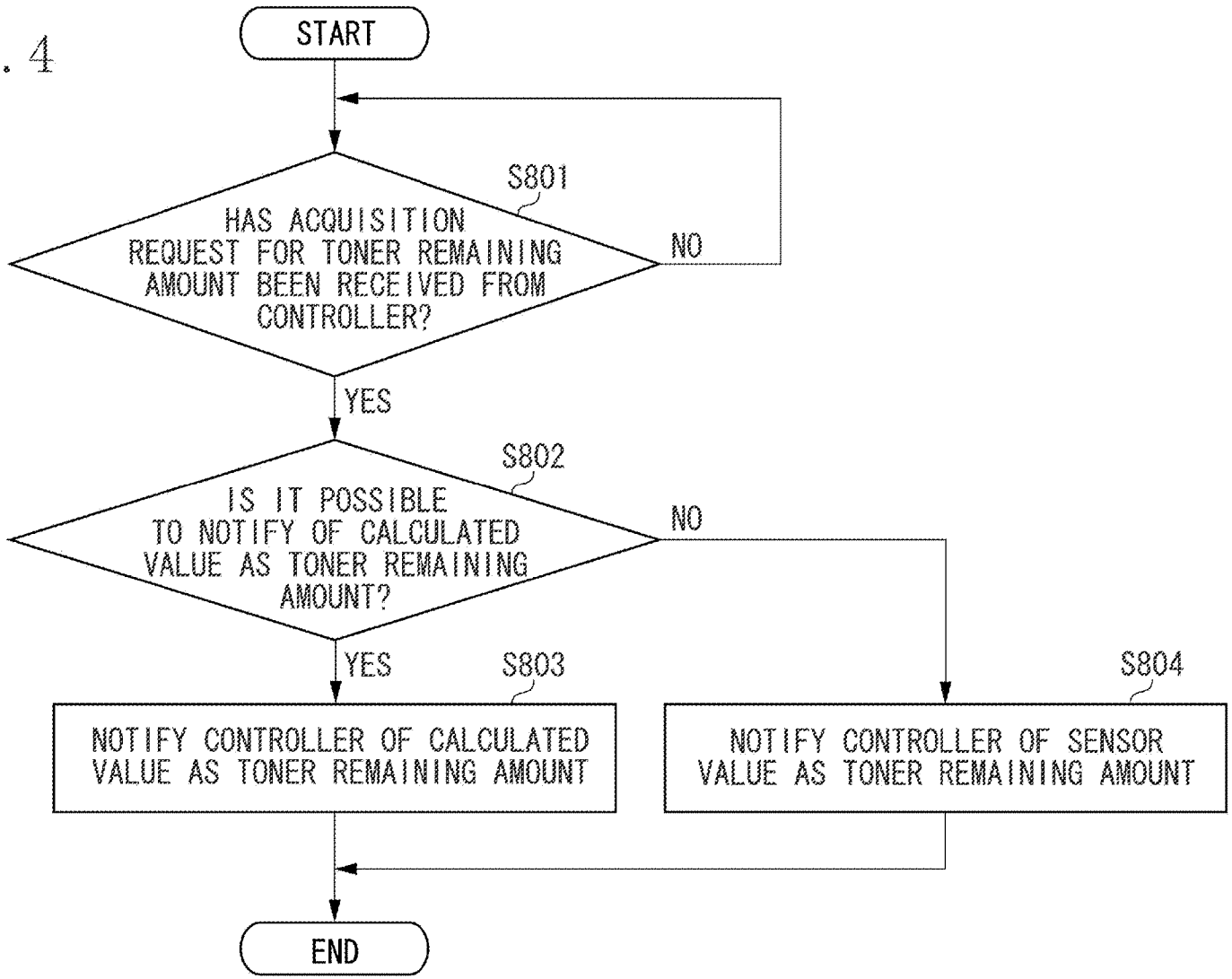
FIG. 4 is a flowchart illustrating exemplary information processing performed by a printer engine.

FIG. 4 is a flowchart illustrating exemplary information processing performed by the printer engine 314 when the controller 313 makes a request to the printer engine 314 for acquiring the toner remaining amount. A purpose of the information processing of the flowchart of FIG. 4 is that the printer engine 314 notifies of the toner remaining amount in response to the acquisition request for the toner remaining amount from the controller 313.

In step S801, the printer engine 314 determines whether an acquisition request for the toner remaining amount has been received from the controller 313.

In a case where the acquisition request for the toner remaining amount has not been received (NO in step S801), the processing returns to the determination processing in step S801.

In a case where the acquisition request for the toner remaining amount has been received (YES in step S801), the processing proceeds to step S802. In step S802, the printer engine 314 determines whether it is possible to notify of the calculated value as the toner remaining amount. That is, in the present exemplary embodiment, the printer engine 314 determines whether the calculated value has been determined.

In a case where it is possible to notify of the calculated value (YES in step S802), the processing proceeds to step S803. In step S803, the printer engine 314 notifies the controller 313 of the calculated value as the toner remaining amount, and ends the processing of the flowchart illustrated in FIG. 4.

In a case where it is not possible to notify of the calculated value (NO in step S802), the processing proceeds to step S804. In step S804, the printer engine 314 notifies the controller 313 of the sensor value as the toner remaining amount, and ends the processing of the flowchart illustrated in FIG. 4.

A purpose of the present exemplary embodiment is to allow the controller 313 to grasp the toner remaining amount in a refilled cartridge, detect that the toner remaining amount has run out at the timing when it has occurred, and display a warning to that effect to the user. Here, an outline of information processing performed in the environment of the present exemplary embodiment will be described. This information processing is from when the device 103 on which the refilled cartridge is mounted receives a print job, until when the fact that the toner remaining amount has run out is displayed to the user.

The device 103 receives the print job from the PC 102 via the USB I/F 306 or the LAN I/F 311. In a case where the printing is complete and there is no more print job in the apparatus, and the number of printed sheets counted since the controller 313 has previously acquired the sensor value as the toner remaining amount from the printer engine 314 exceeds a threshold, the controller 313 puts the printer engine 314 to a sleep mode and then recovers the printer engine 314 from the sleep mode immediately. In this way, the printer engine 314 can be set to a state of notifying of the sensor value as the toner remaining amount. Details of the processing up to this point will be described with reference to FIG. 5 described below.

Thereafter, the controller 313 acquires the toner remaining amount from the printer engine 314. Here, the toner remaining amount notified of by the printer engine 314 is a sensor value. When the acquired toner remaining amount (sensor value) is 0, the controller 313 displays to the user that the toner remaining amount has run out. Details of the processing up to this point will be described with reference to FIG. 6 described below.

Figure 5:
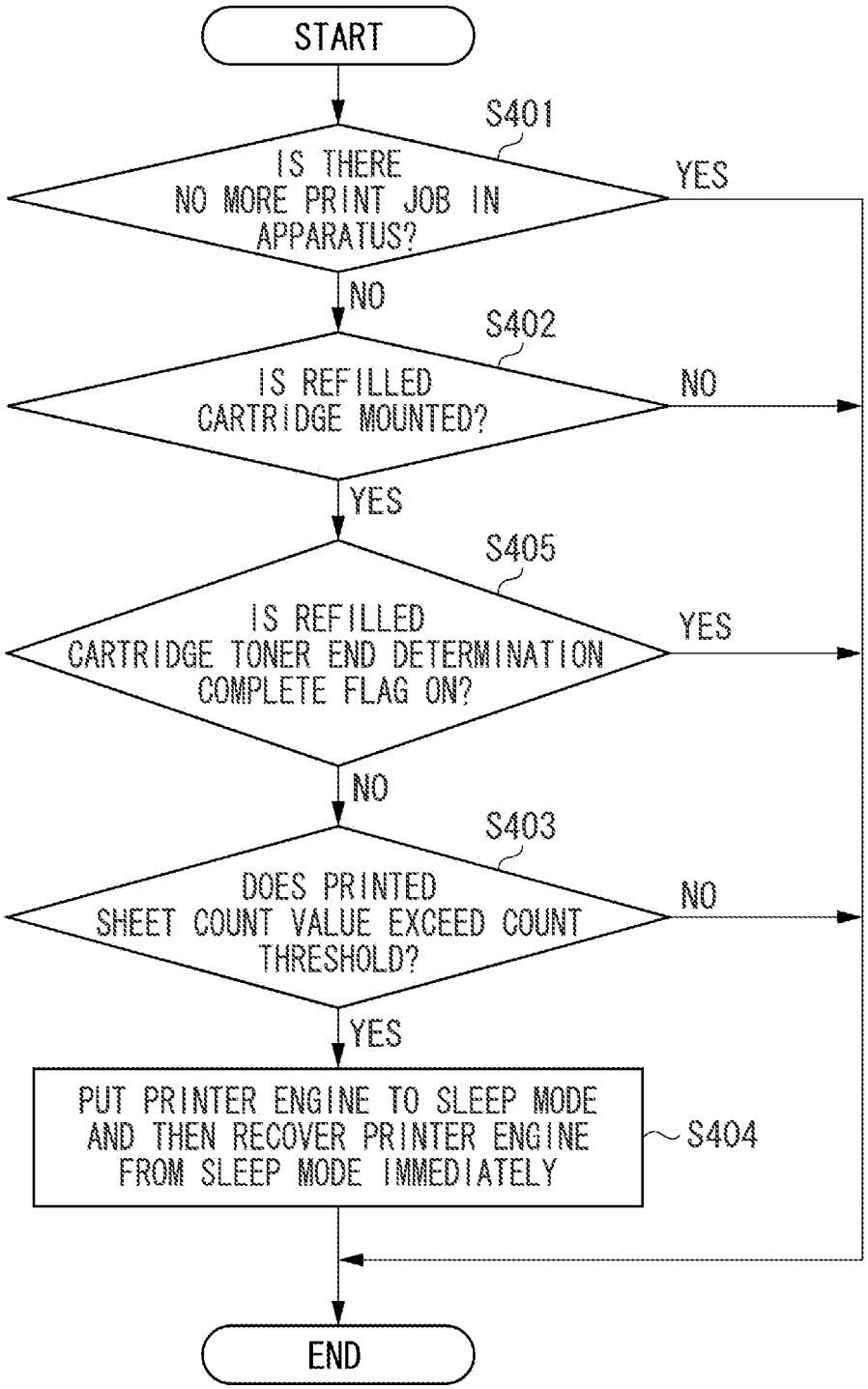
FIG. 5 is a flowchart (part 1) illustrating exemplary information processing performed by a controller.

FIG. 5 is a flowchart illustrating exemplary information processing performed by the controller 313 when the print job is completed by the device 103. A purpose of the information processing of the flowchart of FIG. 5 is to set the printer engine 314 to a state of notifying of the sensor value as the toner remaining amount in a case where a specific condition is satisfied.

In step S401, the controller 313 determines whether there is no more print job in the apparatus (image forming apparatus).

In a case where there is still a print job in the apparatus (YES in step S401), the processing of the flowchart illustrated in FIG. 5 is ended.

In a case where there is no more print job in the apparatus (NO in step S401), the processing proceeds to step S402. In step S402, the controller 313 determines whether a refilled cartridge is mounted. In the present exemplary embodiment, the controller 313 determines whether the refilled cartridge is mounted based on whether information indicating that the cartridge is a refilled cartridge is written in a memory tag of the cartridge, but this determination may be made using a different method.

In a case where the refilled cartridge is not mounted (NO in step S402), the processing of the flowchart illustrated in FIG. 5 is ended.

In a case where the refilled cartridge is mounted (YES in step S402), the processing proceeds to step S405. In step S405, the controller 313 determines whether a refilled cartridge toner end determination complete flag is ON. The refilled cartridge toner end determination complete flag is information that is ON when the controller 313 detects the toner end in the refilled cartridge and cleared to OFF when the cartridge is replaced with another one. Since the refilled cartridge toner end determination complete flag is stored in the RAM 303, the flag is also cleared to OFF by the reboot of the device 103.

In a case where the refilled cartridge toner end determination complete flag is ON (YES in step S405), the processing of the flowchart illustrated in FIG. 5 is ended.

In a case where the refilled cartridge toner end determination complete flag is not ON (NO in step S405), the processing proceeds to step S403. In step S403, the controller 313 determines whether a printed sheet count value exceeds a count threshold. The printed sheet count value is the number of printed sheets counted since the sensor value has previously been acquired as the toner remaining amount from the printer engine 314. The count threshold is a threshold set for the printed sheet count value. The count threshold is determined in the processing of step S505 in FIG. 6, and a method for determining the count threshold will be described with reference to FIG. 7 described below.

In a case where the printed sheet count value does not exceed the count threshold (NO in step S403), the processing of the flowchart illustrated in FIG. 5 is ended.

In a case where the printed sheet count value exceeds the count threshold (YES in step S403), the processing proceeds to step S404. In step S404, the controller 313 puts the printer engine 314 to the sleep mode and then recovers the printer engine 314 from the sleep mode immediately, and thereafter the processing of the flowchart illustrated in FIG. 5 is ended.

As described above with reference to FIG. 4, in a case where the printer engine 314 is recovered from the sleep mode, the printer engine 314 cannot determine the calculated value for a certain period (that is, NO in step S802); therefore, the processing proceeds to step S804. Then, the printer engine 314 is set to a state of notifying of the sensor value in response to the acquisition request for the toner remaining amount from the controller 313. In this way, through the processing in step S404 performed by the controller 313, the printer engine 314 is temporarily set to the state of notifying of the sensor value as the toner remaining amount. In the present exemplary embodiment, the processing of setting the printer engine 314 to the state of notifying of the sensor value as the toner remaining amount is putting the printer engine 314 to the sleep mode and then recovering the printer engine 314 from the sleep mode, but other processing may be performed as long as similar effects can be obtained.

The timing of performing the processing of the flowchart of FIG. 5 is set to when a print job is completed, and the condition of step S401 is provided. This is because, by performing the processing of step S404 when there is no print job in the apparatus, the influence on the printing performance can be avoided. The conditions of steps S402 and S403 are provided so that the frequency of performing the processing of step S404 is minimized so as not to affect the service life of the printer engine 314.

Figure 6:
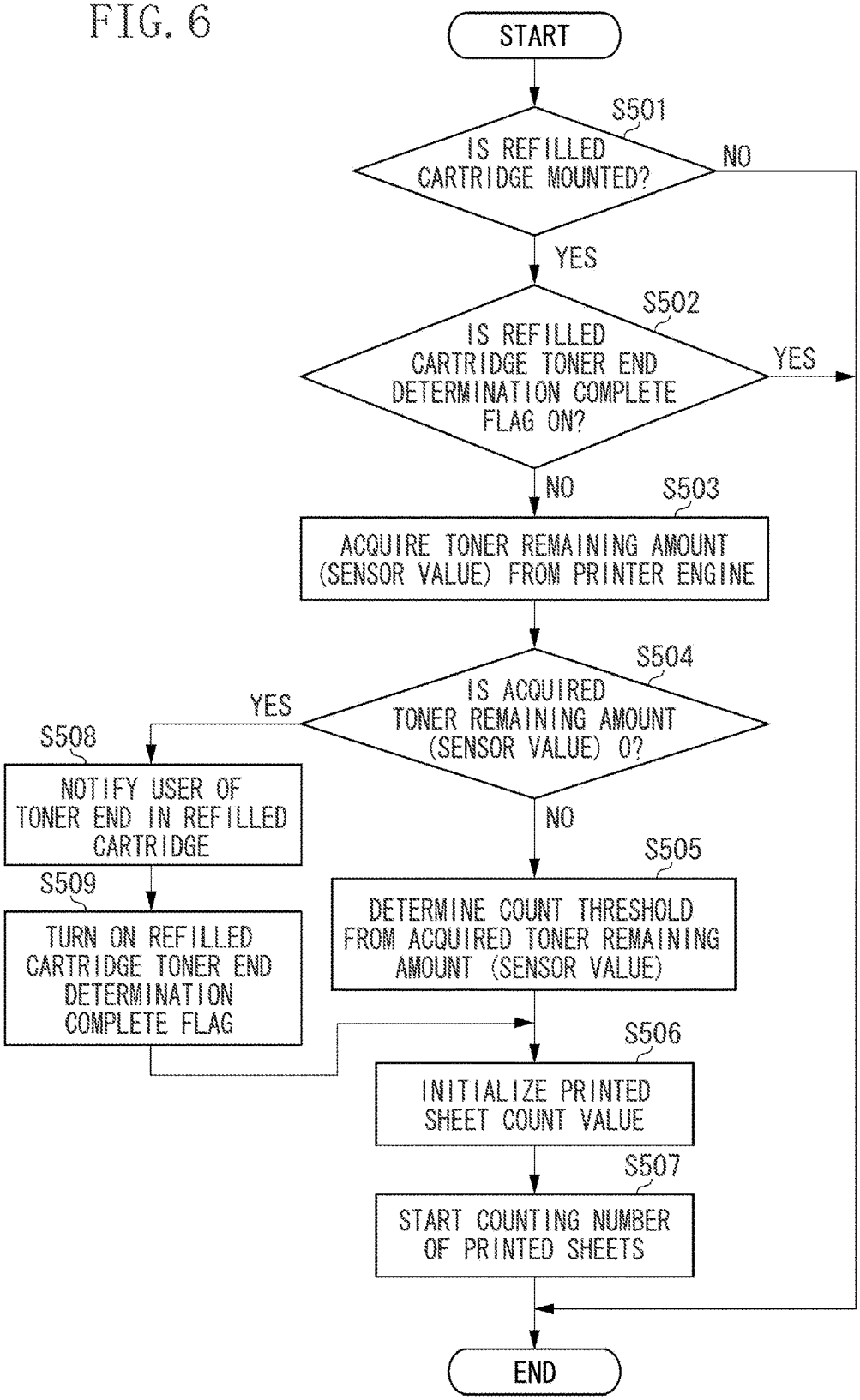
FIG. 6 is a flowchart (part 2) illustrating the exemplary information processing performed by the controller.

FIG. 6 is a flowchart illustrating exemplary information processing performed by the controller 313 at the following timing of the device 103. The timing is the timing at which the printer engine 314 returns the sensor value from among the sensor value and the calculated value in response to a request for the toner remaining amount from the controller 313. For example, this timing is any of when the power is turned on, when the cover to be accessed at the time of cartridge exchange is closed, and when the printer engine 314 is recovered from the sleep mode. A purpose of the information processing of the flowchart of FIG. 6 is that the controller 313 acquires the sensor value as the toner remaining amount in a case where a specific condition is satisfied, and detects the toner remaining amount in a refilled toner cartridge. If there remains no toner, a warning indicating the lack of toner is displayed to the user.

In step S501, the controller 313 determines whether a refilled cartridge is mounted on the apparatus.

In a case where the refilled cartridge is not mounted (NO in step S501), the processing of the flowchart illustrated in FIG. 6 is ended.

In a case where the refilled cartridge is mounted (YES in step S501), the processing proceeds to step S502. In step S502, the controller 313 determines whether a refilled cartridge toner end determination complete flag is ON.

In a case where the refilled cartridge toner end determination complete flag is ON (YES in step S502), the processing of the flowchart illustrated in FIG. 6 is ended.

In a case where the refilled cartridge toner end determination complete flag is not ON (NO in step S502), the processing proceeds to step S503. In step S503, the controller 313 acquires the toner remaining amount from the printer engine 314. Here, the toner remaining amount notified of by the printer engine 314 is a sensor value. In step S504, the controller 313 determines whether the acquired toner remaining amount (sensor value) is 0.

In a case where the acquired toner remaining amount (sensor value) is not 0 (NO in step S504), the processing proceeds to step S505. In step S505, the controller 313 determines a count threshold from the acquired toner remaining amount (sensor value). A method for determining the count threshold will be described with reference to FIG. 7. In step S506, the controller 313 initializes the printed sheet count value. In step S507, the controller 313 starts counting the number of printed sheets, and ends the processing of the flowchart illustrated in FIG. 6.

In a case where the acquired toner remaining amount (sensor value) is 0 (YES in step S504), the processing proceeds to step S508. In step S508, the controller 313 notifies the user of the toner end in the refilled cartridge. The controller 313 displays a UI screen, which will be described with reference to FIG. 8 described below, on the operation/display unit 316 of the device 103 to notify of the toner end. In step S509, the controller 313 turns on the refilled cartridge toner end determination complete flag stored in the RAM 303. In step S506, the controller 313 initializes the printed sheet count value. In step S507, the controller 313 starts counting the number of printed sheets, and the processing of the flowchart illustrated in FIG. 6 is ended.

FIG. 7 is a diagram illustrating an exemplary correspondence table between the toner remaining amount (sensor value) and the count threshold. The correspondence table is used when the count threshold is determined in step S505 based on the toner remaining amount (sensor value) acquired from the printer engine 314 by the controller 313.

In the present exemplary embodiment, the sensor value is obtained by rounding up a value obtained by reading the toner remaining amount in the cartridge by an optical sensor to any one of 100, 40, 20, 10, and 0. Therefore, for example, when the value read by the optical sensor is 41, the sensor value is 100 obtained by rounding up 41. In the present exemplary embodiment, it is assumed that one new cartridge contains, for example, toner corresponding to 1000 sheets of printing.

When the toner remaining amount (sensor value) acquired in step S503 is, for example, 100, the controller 313 sets the number of printed sheets equivalent to 30% of the cartridge capacity, that is, 300 sheets, as the count threshold based on the correspondence table 601. When the toner remaining amount (sensor value) acquired in step S503 is, for example, 10, the controller 313 sets the number of printed sheets equivalent to 3% of the cartridge capacity, that is, 30 sheets, as the count threshold. When the acquired toner remaining amount (sensor value) is high, the count threshold is set high because there is still enough amount remaining before the toner end. Conversely, when the acquired toner remaining amount (sensor value) is low, the amount is close to the toner end and thus the count threshold is set low. This is for minimizing the frequency of performing the processing of step S404 so as not to affect the service life of the printer engine 314.

Figure 8:
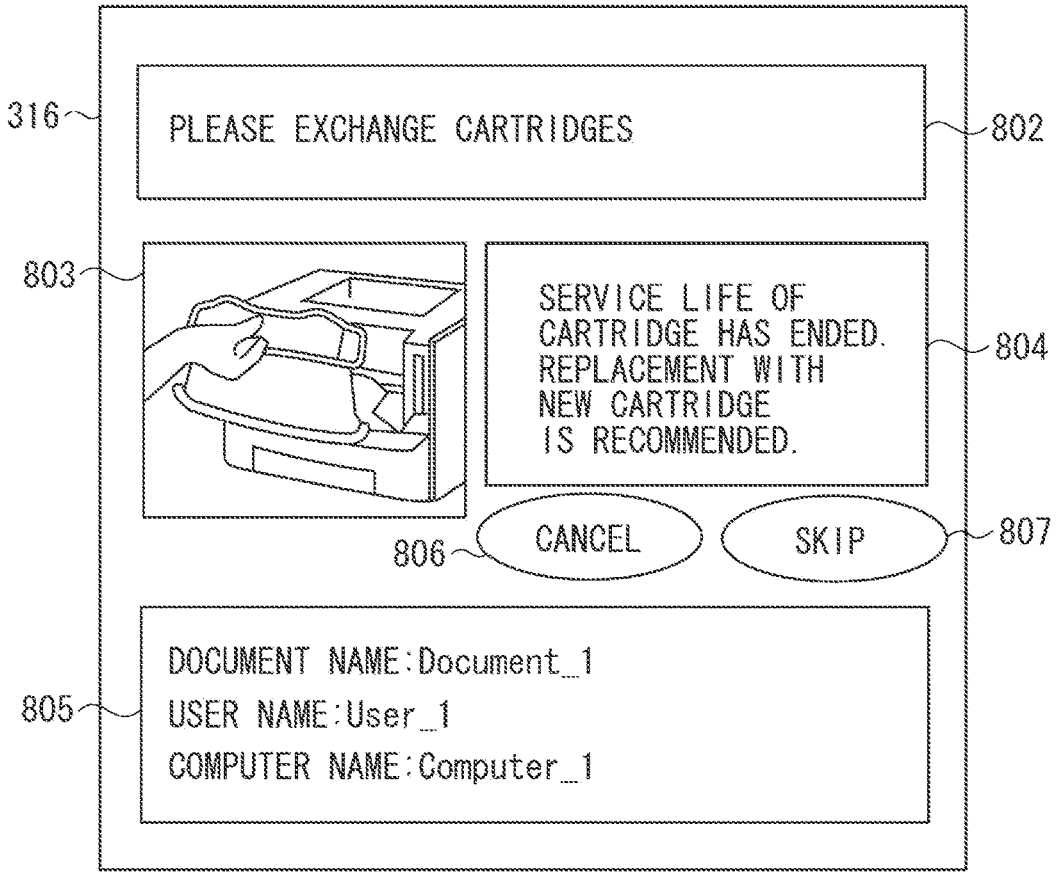
FIG. 8 is a view illustrating an exemplary user interface (UI) screen.

FIG. 8 is a view illustrating an exemplary UI screen displayed on the operation/display unit 316 of the device 103 when printing is stopped due to a toner end in the course of printing. A message recommending exchange of cartridges is displayed on a main message part 802 and an auxiliary message part 804. An illustration describing replacement of the toner cartridge is displayed on a status screen part 803. Information (a document name, a user name, and a computer name) of a print job of which printing is stopped is displayed on a print job information part 805. A user who wants to cancel the print job being executed can cancel the printing of the print job being executed by selecting a job cancel button 806. On the other hand, a user who wants to resume the printing of the print job being executed after exchanging cartridges can clear the error and resume the printing of the print job being executed by exchanging the cartridges according to the display on this screen without selecting the job cancel button 806. A user who wants to resume the printing of the print job being executed without exchanging cartridges can skip the error and resume the printing of the print job being executed by selecting an error skip button 807.

By performing the information processing described above, even in a case where a refilled cartridge is mounted on an image forming apparatus in which the printer engine 314 is equipped with one interface corresponding to the toner remaining amount, the controller 313 can appropriately grasp the toner remaining amount. In addition, the controller 313 can detect that the toner remaining amount has run out at the timing when it has occurred, and display a warning to that effect to the user. The controller 313 can realize the above without affecting the printing performance or the service life of the printer engine.

According to one or more aspects of the present exemplary embodiment, it is possible to appropriately grasp the toner remaining amount of a refilled cartridge.

Other Embodiments

Embodiments of the present disclosure can also be realized by a computer of a system or apparatus that reads out and executes computer executable instructions recorded on a storage medium (e.g., non-transitory computer-readable storage medium) to perform the functions of one or more of the above-described embodiment(s) of the present disclosure, and by a method performed by the computer of the system or apparatus by, for example, reading out and executing the computer executable instructions from the storage medium to perform the functions of one or more of the above-described embodiment(s). The computer may comprise one or more processors, one or more memories, one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Although the exemplary embodiments of the present disclosure have been described in detail above, the present disclosure is not limited to the specific exemplary embodiments.

As described above, according to the processing of one or more aspects of the exemplary embodiments described above, it is possible to appropriately grasp the toner remaining amount of a refilled cartridge.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-151271, filed Aug. 1, 2016, which is hereby incorporated by reference herein in its entirety.

What is claimed is:

1. An image forming apparatus comprising:

at least one processor configured to function as:

a printer engine configured to perform image formation using a recording material stored in a cartridge; and a printer controller communicably connected to the printer engine, wherein the printer engine:

notifies the printer controller of a predicted value predicted based on a consumption amount of the recording material upon condition that an engine state does not satisfy a predetermined state, and notifies the printer controller of raw data acquired using a sensor, instead of the predicted value, upon condition that the engine state satisfies the predetermined state, and wherein the printer controller:

determines whether a cartridge mounted on the image forming apparatus is a cartridge refilled with a recording material, if it is determined that the cartridge mounted on the image forming apparatus is the cartridge refilled with the recording material, performs control for shifting the printer engine to a predetermined state, acquires the raw data from the printer engine that has been shifted to the predetermined state, and notifies a user of a degree of wear of the cartridge based on the acquired raw data, and if it is determined that the cartridge mounted on the image forming apparatus is not the cartridge refilled with the recording material avoids performing the control for shifting the printer engine to the predetermined state, acquires the predicted value from the printer engine, and notifies the user of the degree of wear of the cartridge based on the acquired predicted value.

2. The image forming apparatus according to claim 1, wherein the printer engine calculates the predicted value based on at least the raw data acquired using the sensor and the consumption amount of the recording material.

3. The image forming apparatus according to claim 1, wherein the printer controller shifts the printer engine to the predetermined state by performing control for rebooting the printer engine.

4. The image forming apparatus according to claim 1, wherein the printer controller transmits an acquisition request for a toner remaining amount to the printer engine, and wherein the printer engine notifies the printer controller of the predicted value in response to the acquisition request upon condition that the engine state does not satisfy the predetermined state, and notifies the printer controller of the raw data upon condition that the engine state satisfies the predetermined state.

5. The image forming apparatus according to claim 1, wherein the printer controller further determines whether there is a print job to be executed, wherein, even if it is determined that the cartridge mounted on the image forming apparatus is the cartridge refilled with the recording material, and it is determined that there is a print job to be executed, the printer controller performs the control for shifting the printer engine to the predetermined state after execution of the print job is completed.

6. A method for controlling an image forming apparatus comprising:

at least one processor configured to function as:

a printer engine configured to perform image formation using a recording material stored in a cartridge; and a printer controller communicably connected to the printer engine, the method comprising:

notifying, by the printer engine, the printer controller of a predicted value predicted based on a consumption amount of the recording material upon condition that an engine state does not satisfy a predetermined state;

notifying, by the printer engine, the printer controller of raw data acquired using a sensor, instead of the predicted value, upon condition that the engine state satisfies the predetermined state;

determining, by the printer controller, whether a cartridge mounted on the image forming apparatus is a cartridge refilled with a recording material;

if it is determined that the cartridge mounted on the image forming apparatus is the cartridge refilled with the recording material, performing, by the printer controller, control for shifting the printer engine to a predetermined state, acquiring the raw data from the printer engine that has been shifted to the predetermined state, and notifying a user of a degree of wear of the cartridge based on the acquired raw data; and if it is determined that the cartridge mounted on the image forming apparatus is not the cartridge refilled with the recording material, avoiding performing the control for shifting the printer engine to the predetermined state, acquiring the predicted value from the printer engine, and notifying the user of the degree of wear of the cartridge based on the acquired predicted value.

7. A non-transitory storage medium storing a computer-readable program for causing a computer to execute a method for controlling an image forming apparatus comprising:

at least one processor configured to function as:

a printer engine configured to perform image formation using a recording material stored in a cartridge; and a printer controller communicably connected to the printer engine, the method comprising:

notifying, by the printer engine, the printer controller of a predicted value predicted based on a consumption amount of the recording material upon condition that an engine state does not satisfy a predetermined state predetermined state;

notifying, by the printer engine, the printer controller of raw data acquired using a sensor, instead of the predicted value, upon condition that the engine state satisfies the predetermined state;

determining, by the printer controller, whether a cartridge mounted on the image forming apparatus is a cartridge refilled with a recording material;

if it is determined that the cartridge mounted on the image forming apparatus is the cartridge refilled with the recording material, performing, by the printer controller, control for shifting the printer engine to a predetermined state, acquiring the raw data from the printer engine that has been shifted to the predetermined state, and notifying a user of a degree of wear of the cartridge based on the acquired raw data; and if it is determined that the cartridge mounted on the image forming apparatus is not the cartridge refilled with the recording material, avoiding performing the control for shifting the printer engine to the predetermined state, acquiring the predicted value from the printer engine, and notifying the user of the degree of wear of the cartridge based on the acquired predicted value.

8. A printer controller that performs printing using a printer engine configured to perform image formation using a recording material stored in a cartridge, the printer controller comprising:

at least one processor configured to determine whether a cartridge mounted on the image forming apparatus is a cartridge refilled with a recording material;

if it is determined that the cartridge mounted on the image forming apparatus is the cartridge refilled with the recording material, perform control for shifting the printer engine to a predetermined state, acquire raw data acquired using a sensor from the printer engine that has been shifted to the predetermined state, and notify a user of a degree of wear of the cartridge based on the acquired raw data, and if it is determined that the cartridge mounted on the image forming apparatus is not the cartridge refilled with the recording material, avoid performing the control for shifting the printer engine to the predetermined state, acquire a predicted value predicted based on a consumption amount of the recording material from the printer engine, and notify the user of the degree of wear of the cartridge based on the acquired predicted value.

* * * * *